United States Patent [19]

Mahon, III

[11] 4,078,272

[45] Mar. 14, 1978

[54] MULTIPLE TOOL IMPLEMENT

[76] Inventor: Charles A. Mahon, III, 5929 Ralston Ave., Richmond, Calif. 94805

[21] Appl. No.: 758,168

[22] Filed: Jan. 10, 1977

[51] Int. Cl.[2] ..... B26B 11/00

[52] U.S. Cl. ..... 24/186; 7/118; 7/168

[58] Field of Search ..... 7/14.25; 24/163 R, 186; 30/152, 161

[56] References Cited

U.S. PATENT DOCUMENTS

| | | | |
|---|---|---|---|
| 2,807,085 | 9/1957 | Combs | 7/14.25 X |
| 3,175,233 | 3/1965 | Caravella | 7/14.25 |
| 3,832,775 | 9/1974 | Stahel et al. | 30/152 |

*Primary Examiner*—James L. Jones, Jr.
*Assistant Examiner*—James G. Smith
*Attorney, Agent, or Firm*—Daniel C. Block

[57] ABSTRACT

This invention relates to a belt buckle uniquely combined with a tool implement having multiple-purpose uses. More specifically, this invention relates to a belt buckle so uniquely shaped and dimensional so as to house a cutting instrument and multi-tool implement that are foldable into the body of said buckle in a unique manner and wherein the buckle itself can be employed as a tool implement to remove caps and the like.

3 Claims, 3 Drawing Figures

MULTIPLE TOOL IMPLEMENT

BACKGROUND OF THE DISCLOSURE

There are many multiple-tool implements readily available on the market as is well understood in this art. One such implement consists of a number of tools resiliently biased by an integral spring and disposed betweeen two plates of differing shape which cooperate to form finger recesses on one side of the implement and having an assembly of tools disposed between the plates. An example of this type of tool implement is described in U.S. Pat. No. 3,600,729.

Another utility implement commonly found in the art consists of a combination of knife, fork and spoon and container opener which may be assembled as a compact unit with various other members being held together in locking engagement. The assembly consists of an opener having a handle portion which receives the handles of the knife, fork and spoon and the blade of a knife. Thus, each of the elements are releasably engaged to form a cutlery combination having mutliple-functional uses. Such an implement is described in U.S. Pat. No. 3,389,412.

Finally, the art describes belt buckles having a plurality of end uses. One such belt buckle consists of spaced-apart perforations approximate to one end which can be used as a can-opening device and/or bottle-opening device. Such an implement is found in U.S. Pat. No. 3,175,233.

It is recognized, of course, that pocket knives and such implements provided with knife blades and like instruments are available on the market. Additionally, some of these knives are provided with loops on one end of the body portion thereof to be connected to a chain or string or other similar type of attachment so as to afford availability of the pocket knife. These types of securing devices are to prevent loss and/or theft of the pocket knife. However, nothing in the prior art has been described or claimed which consists of a belt buckle which can be employed as a protection or sheath for a knife blade and/or other type of instrument and can similarly function to open bottles or cans as the case may be.

DETAILED DESCRIPTION OF THE INVENTION

Figure 2:
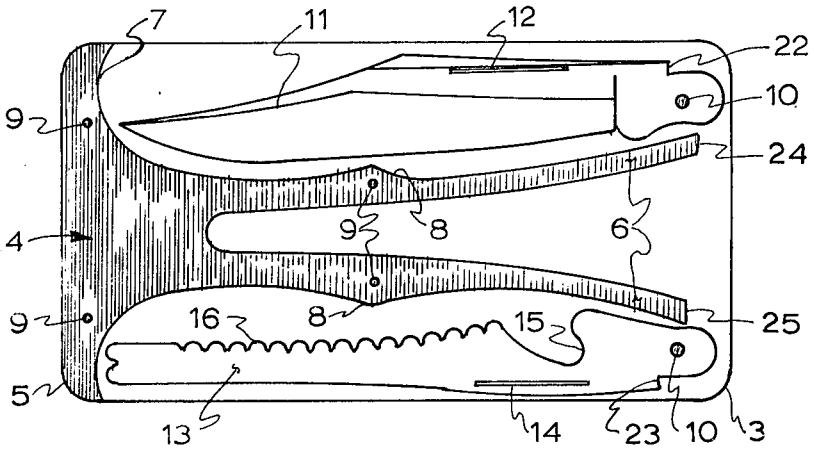
FIG. 2 is a plan view of the belt buckle with the top portion removed to show internal details.
Figure 1:
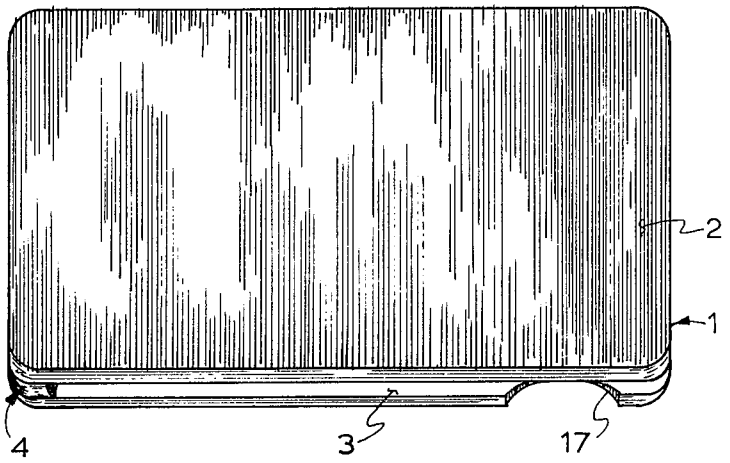
FIG. 1 is an isometric view of the belt buckle wherein the blades are in the closed position.

Referring now to the drawings, the buckle and cutlery tool assembly is generally indicated at 1 and comprises an upper body portion 2 and a spaced apart lower body portion 3. The body portions 2 and 3 are separated by a spring member indicated at 4. The outer surface of the upper body portion 2 is adapted to be provided with an engraving or ornamental design to promote the aesthetic observation of the buckle and cutlery tool assembly.

As illustrated more clearly in FIG. 2, the spring member 4, intermediate body portions 2 and 3, is provided with a lateral body section 5 and leg sections generally indicated at 6. The lateral body section 5 is provided with arm sections 7 essentially the entire width of the body portions 2 and 3 and are rigidly mounted to the body portions 2 and 3 by anchor pins 9. Intermediate to the ends of the leg portions 6, enlarged portions 8 are provided to strengthen the spring members 6 and are also rigidly anchored to the body portions as indicated by pins 9.

At one side of the body portions 2 and 3, a cutting blade member 11 is pivotly mounted to the body portions 2 and 3 as indicated at 10. The blade portion 11 is provided with fingernail indentations 12 to facilitate removal of the blade around the pivot pin 10. The blade portion 11 adjacent to the pivot pin 10 is approximately the same width as the leg portion 6 of spring member 4 and abut each other. In this manner, the blade 11 is resiliently held in position at all times. Thus, when the operator grasps the blade at indentations 12 and pulls the same outwardly, the blade rotates around pivot pin 10 until abutment 22 on the blade abuts the end of the spring section 6 at 24. In this manner, blade 11 is in an extended position and resiliently held in such position.

On the other side of buckle 1 of body portions 2 and 3 is provided another blade 13 which may be broadly described as a utility blade which is also pivotly mounted at 10 adjacent to the other leg 6 in essentially the same manner as blade 11. The utility blade 13 is provided with fingernail indentations 14 to facilitate pivoting the member around pivot pin 10. The utility blade 13 is provided with a rasping or scraping section indicated at 16 to facilitate removal of fish scales and the like and also an indentation indicated at 15 for opening cans and like members.

Figure 3:
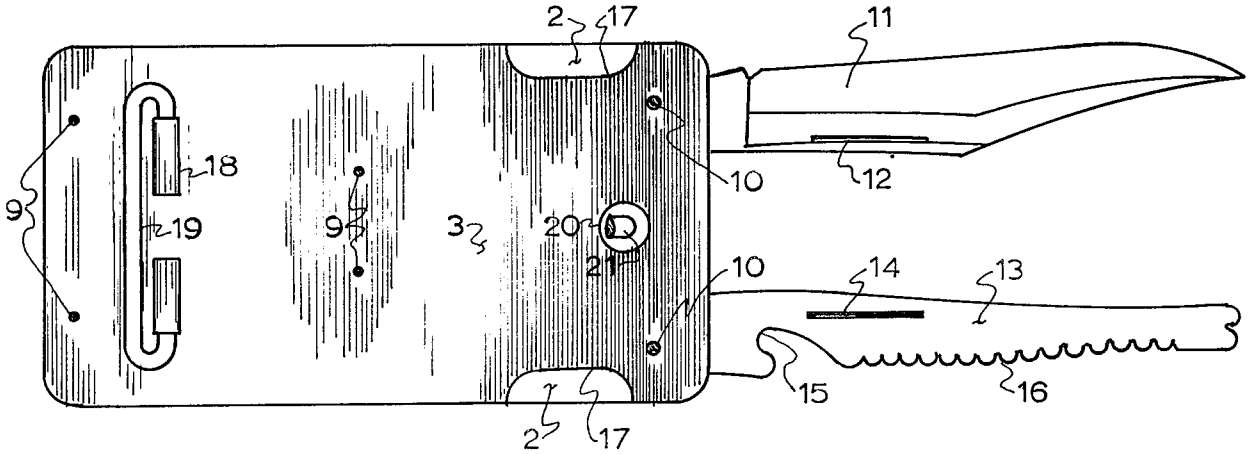
FIG. 3 is a plan view of the bottom portion of the belt buckle with the blades in the extended position.

As indicated more clearly in FIG. 3, the bottom portion 3 is provided with indentations or cutaway portion 17 to facilitate ease in obtaining access to the fingernail indentations 12 and 14. Adjacent the end of the bottom surface portion of body 3 and intermediate the anchor pins 9 and 9', a belt loop member 19 is provided that is rotatively anchored thereto. The anchor members consist of spaced apart tubular anchor portions 18 rigidly mounted thereto as by welding or riveting. The loop 19 extends into the tubular portions 18 and extends outwardly and upwardly integral therefrom as indicated in FIG. 3. On the opposite end of the belt buckle portion 3 is provided an anchor disc 20 having a holding pin 21 extending upwardly and inwardly therefrom. The holding pin 21 is adapted to be inserted into openings through a belt or the like when such belt extends around the waist or other portions of the human body.

In use of the buckle and cutlery utility tool assembly, the end portion at 19 is adapted to be snapped or otherwise affixed to one end of the belt member, not shown. The belt then extends around the body portion or other member with the opposite end thereof being extended through the loop 19 and the pin 21 extending through holes in the middle portion of the belt. In this manner, the buckle and cutlery tool assembly is held in place and is difficult to be lost or otherwise disposed of.

The pin 21 which is anchored to the body portion 3 is selected in dimensions to extend upwardly and inwardly to such a degree that it can be placed beneath the lip of a bottle cap with the bottom portion 3 above the bottle cap and used to open the cap. Moreover, since the body portions 2 and 3 containing blades 11 and 13 are at all times on the belt portion of a sportsman or other type of individual, the same would not be readily lost and/or mislaid as the case may be.

Having described the invention as herein set forth, it will be readily understood that modifications can be made without departing from the spirit of the invention.

What is claimed is:

1. A buckle and multiple-tool implement comprising: an upper body portion and a lower body portion, said upper and lower body portions being spaced apart and having a spring member mounted therebetween; the spring member having a lateral body section at one end of said body portion and leg sections extending toward the other end of said body portions, said leg sections having enlarged portions intermediate the ends thereof, blade members pivotly mounted adjacent said leg portions by pins nearest the other end of said body portions, said leg portions of said spring member resiliently holding said blade members in position, the bottom surface of said bottom body portion having a belt loop pivotly mounted thereon adapted to receive one end of a belt, a holding pin rigidly mounted adjacent said belt loop adapted to be inserted into an opening on the other end of said belt.

2. The implement as set forth in claim 1 wherein said holding pin extends upwardly and inwardly and is dimensioned to be placed beneath the lip of a bottle cap.

3. The implement of claim 2 together with means on said blades that abut the ends of said leg sections to hold the blades in an open position.

* * * * *